United States Patent [19]

Stahlecker et al.

[11] 4,137,699

[45] Feb. 6, 1979

[54] TEXTILE MACHINE WITH DEVICES FOR DETERMINATION OF THE TRANSVERSE DIMENSION OF RUNNING YARN

[75] Inventors: Fritz Stahlecker, Josef-Neidhart-Strasse 18, 7341 Bad Überkingen, Fed. Rep. of Germany; Erich Loepfe, Pfaffhausen, Switzerland

[73] Assignees: Hans Stahlecker; Fritz Stahlecker, both of Fed. Rep. of Germany

[21] Appl. No.: 888,654

[22] Filed: Mar. 21, 1978

[30] Foreign Application Priority Data

Mar. 31, 1977 [DE] Fed. Rep. of Germany ..... 2714353

[51] Int. Cl.[2] ..... D01H 15/00; D01H 13/16

[52] U.S. Cl. ..... 57/264; 57/81; 57/263

[58] Field of Search ..... 57/34 R, 56, 58.89–58.95, 57/81, 156; 242/35.5 R, 35.6 R

[56] References Cited

U.S. PATENT DOCUMENTS

| | | | |
|---|---|---|---|
| 3,486,319 | 12/1969 | Lee, Jr. et al. | 57/81 X |
| 3,660,972 | 5/1972 | Neill et al. | 57/34 R |
| 3,680,297 | 8/1972 | Lee, Jr. | 57/34 R |
| 3,680,299 | 8/1972 | Lee, Jr. | 57/34 R |
| 3,908,347 | 9/1975 | Vignon | 57/81 X |
| 3,988,879 | 11/1976 | Franzolini et al. | 57/34 R |
| 3,992,864 | 11/1976 | Igel | 57/34 R |
| 4,028,869 | 6/1977 | Schafer et al. | 57/81 X |
| 4,060,965 | 12/1977 | Schwartz | 57/34 R |

*Primary Examiner*—John Petrakes
*Attorney, Agent, or Firm*—Craig & Antonelli

[57] ABSTRACT

Open-end spinning machine apparatus is provided which includes a yarn measuring device at each of the individual spinning units for determining the transverse dimension of the running yarn produced at the spinning units. In addition, intermediate storage means are provided for electronically storing yarn measurement data at each of the individual spinning units. In order to process the yarn measurement data, a process computer is provided at a mobile servicing instrument which is selectively movable to respective servicing positions at the spinning units. The process computer and mobile servicing instrument also includes means for carrying out servicing operations at the respective spinning units in the event of detected yarn flaws or the like. By providing the process computer at the mobile servicing unit, with individual separate intermediate storage systems at each spinning unit, the total cost for electronic equipment is substantially minimized while obtaining all of the advantages of a complete computerized analysis system. According to certain preferred embodiments the circuitry at the individual spinning units is designed to store data as to periodic yarn defects leading to a moiré appearance. In other preferred embodiments, the circuitry at the spinning units is designed to provide data storage indicating deviations of the yarn dimensioned from predetermined minimum and maximum standards.

20 Claims, 6 Drawing Figures

15
57
58
59
16
T1
28
10
52
A1
53
B1
54
A
D
55
31
56-1
32
33
51
61
62
27
60
2

28
63
64
A2
(59)
54
55
B2
A
D
33
32
31
56-2

Fig. 4
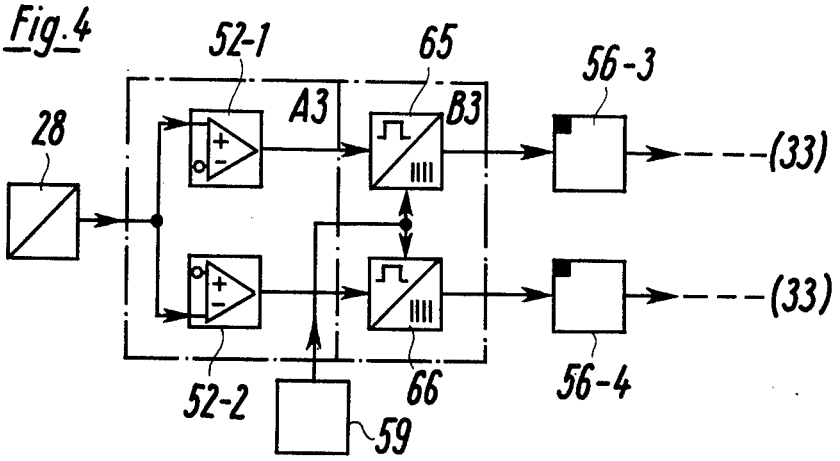
Fig. 5
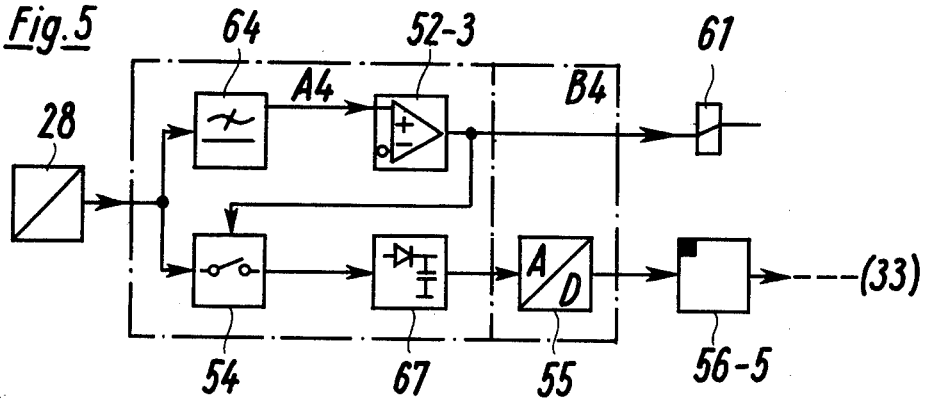
Fig. 6
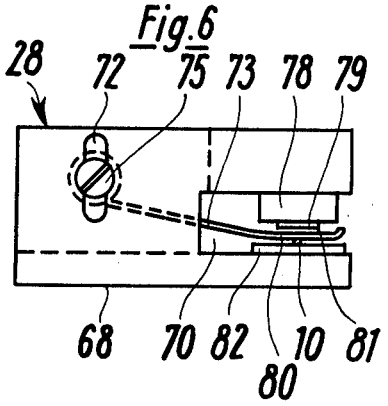
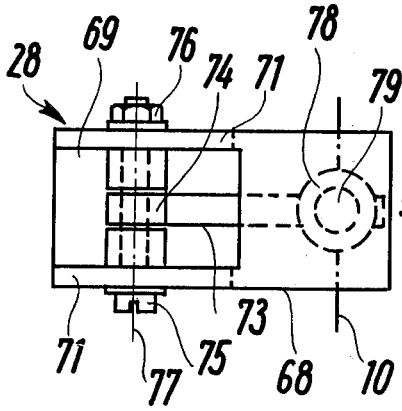
Fig. 7

TEXTILE MACHINE WITH DEVICES FOR DETERMINATION OF THE TRANSVERSE DIMENSION OF RUNNING YARN

BACKGROUND AND SUMMARY OF THE INVENTION

The invention concerns a textile machine, especially an open-end spinning machine with a plurality of production units respectively having a device for determination of the transverse dimensions of running yarn, connected via electronic switching circuits and intermediate storage to a common data processing facility.

In yarn-producing textile machines, e.g. in open-end spinning machines, there are yarn defects that lead not only to yarn breaks but also to fluctuations of yarn thickness or other irregularities. These yarn flaws can pronouncedly affect further processing and in some circumstances the surface texture from this yarn will end in production of goods that have to be rejected. This is especially true of slight fluctuations in thickness and other irregularities that occur periodically at regular intervals, where the surface texture produced from this yarn has a moiré appearance. In ravelling out of unknitting yarns, there can be substantial extra cost involved, even if only a single spool has a defective yarn.

To manage the difficulties indicated above, and to prevent production of defective yarn by individual production units of a spinning machine, even temporarily, it is known from German AS 2,409,882 that with each spinning station there can be associated a device to determine the transverse dimension of the running yarn, the measurements being worked up by a data processing facility. If something unusual occurs, the indicator instruments associated with the spinning station in question will be actuated (signal light, alarm bell, relay switch). This arrangement requires a considerable outlay for electronic and mechanical components to be installed at each spinning assembly, so that it seems questionable, that such outlay would be acceptable in proportion to their use.

In a melt spinning machine, it is also known, from Swiss Pat. No. 551,923, that yarn defects can be determined by electronic sensors and that signals dependent therefrom can be taken to a data processing instrument common to all production units, this processing instrument being connected periodically with the individual production units. This data producing instrument then works up or processes the data delivered to it from the respective units with which it is connected at the moment. In order not entirely to neglect yarn deflects that may occur in the meantime, there are intermediate storage devices associated with each production unit, which are switchable in two binary states. The coarse yarn flaws which may be stored there are than taken in the next sensing period to the date processing instrument instead of the signal taken directly from the production unit in question. Here also there is still a considerable outlay both for electronic and mechanical components that have to be available to evaluate the measurement signals taken at the individual production units, which may be taken from yarn defects. Moreover, only coarse yarn flaws are stored in the intermediate periods.

It is also known (British Pat. No. 1,375,254) that a servicing instrument may be caused to travel past a spinning machine with a plurality of production units winding yarn to spools, said instrument being equipped with detectors that can detect malfunctioning of the individual stations. These detectors are connected with data processing facility that can travel with the servicing instrument, further to work up the malfunctions determined from the outside of the individual production units, and to allow suitable countermeasures. This servicing instrument is not capable however of automatically monitoring the quality of the running yarn and initiating and executing actions, from the date on yarn quality.

The invention is intended to make it possible, in a textile machine of the specified type, to monitor the running yarn without having an excessive outlay for electronic and mechanical components. The invention consists therein that the intermediate storage devices are stationarily disposed in the region of the individual production units, and in that for several or for all production units that is a mobile servicing device or instrument that can be moved along the textile machine, said servicing instrument including a process computer and means to connect the process computer with the intermediate storage of a production unit, as well as at least one function element that is controlled by the process computer and that can be presented to the production unit concerned, for execution of a servicing operation.

By this arrangement it is possible to limit to a minimum the electronic devices needed on each production unit, whereas no extra mechanical devices need be present on the production units in question. By storage of the measurement data, only a relatively short residence time is required for the servicing instrument at the production unit to be serviced, without an unwarranted limitation of the measurement period. It is thereby possible to associate the servicing instrument with the common process computer of a very large number of production units.

The servicing instrument, by means of its function elements, can directly engage in the individual production units and effect a servicing operation without causing a halt.

In a simple embodiment of the invention, it is provided that the servicing instrument will include a function element for characterizing a malfunctioning production unit. In this way it will be easy for the operating personnel to find such malfunctioning units and possibly eliminate the cause of the malfunction.

In preferred embodiments, it is also provided that the servicing instrument will have a function element for interruption of the work process of a malfunctioning production unit. This interruption is important if the yarn flaws that have been detected are so serious that further processing of the produced yarn would not be worthwhile. It may also be provided, according to certain embodiments, that the servicing instrument will have a function element which can be presented to a switch that will prevent automatic switching on again of a malfunctioning production unit. By this arrangement, it is ensured that the production, once stopped by the servicing instrument because of serious yarn flaws, will not be put back into operation without removal of the cause of the defects. To monitor the quality of the individual production units and their susceptibility to disturbance, it may further be provided that the servicing instrument will have a device controlled by the process computer, to issue a control sheet showing the measurements from the tested units.

Since the servicing instrument only passes by the individual production units periodically, there is the risk that in the meantime a yarn will be produced and spun on a spool that has unacceptable defects. In order not to have the whole spool become a reject, in a further embodiment of the invention it is provided that the servicing instrument will have a device for winding off and separating a yarn length determined by the process computer, said device being controlled by the process computer and being capable of being presented to a winding spool of the production unit being tested. It is then determined by the process computer that enough will be wound off to remove the flawed places from the spool. In some situations this winding off will have to go so far that the whole length of yarn will be removed that had been spooled between two monitoring periods.

In a further embodiment of the invention it is provided that the process computer with its interrogating and control devices and with the function elements that it controls will be combined with a traveling servicing device that can execute cleaning and/or yarn piecing and/or spool exchange on the production units. Such servicing devices in a number of cases are already available, so that the outlay for the servicing instrument that will accept the process computer can be diminished. It is especially advantageous to couple the servicing instrument containing the process computer with a traveling spool exchange device, because it is then ensured that no spool exchange will occur without a check of the last yarn that was wound, for freedom from defects.

In a further embodiment of the invention it is provided that each production unit will have a trigger circuit synchronized with the winding spool drive, that controls a periodic storage of measurements in the intermediate storage. This arrangement is advantageous because then the storage capacity of the intermediate storage can be kept to a reasonable size. The periodic storage is to be turned with the desired monitoring function.

In a further embodiment of the invention the device for determining the cross section dimension of the running yarn is connected via two switching circuits with the appurtenant intermediate storage, whereof one is made as an evaluating stage and the other as a conversion stage. Such an arrangement is sufficient for the wanted testing purposes. In order to have detection of periodically occurring yarn defects that lead to undesired moire effects, in an advantageous embodiment of the invention there is an evluation stage provided which produces signals that correspond to the temporal succession of variations of yarn cross section. In this case, it is not absolute values of cross section variations that are involved, but only their position in the produced yarn. Even relatively slight variations in cross section that normally could be ignored sometimes can make the yarn unusable, if they occur periodically.

In order to determine yarn uniformity, in a further embodiment of the invention there is a rectifier stage used as evaluation stage, and an averaging stage connected in series therewith. In this case the uniformity of the yarn is the testing criterion.

If the number of thick and thin places is to be checked as testing criterion, in a further embodiment of the invention, a series circuit comprising comparator and pulse counters is provided as the evaluating stage.

If excessive fluctuations of thickness of the yarn are used for the testing criterion, according to a further embodiment of the invention, it is provided that the evaluation stage will include a comparator and a holding stage, which is connected via a switch controlled by the comparator with the device for determination of cross section dimension of the running yarn and connected to the converter stage.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 4 is a block diagram of electronic switching circuits for determination of thick places and thin places in a running yarn, according to another preferred embodiment of the invention;

FIG. 5 is a block diagram of the electronic switching circuits for determination of unacceptable yarn defects, according to another preferred embodiment of the invention;

FIG. 6 is a view of a device for sensing the cross section dimension of a running yarn, in the direction of the yarn, according to preferred embodiments of the invention; and FIG. 7 is a view of the device of FIG. 6, crosswise to the running direction of the yarn.

DETAILED DESCRIPTION OF THE DRAWINGS

Figure 1:
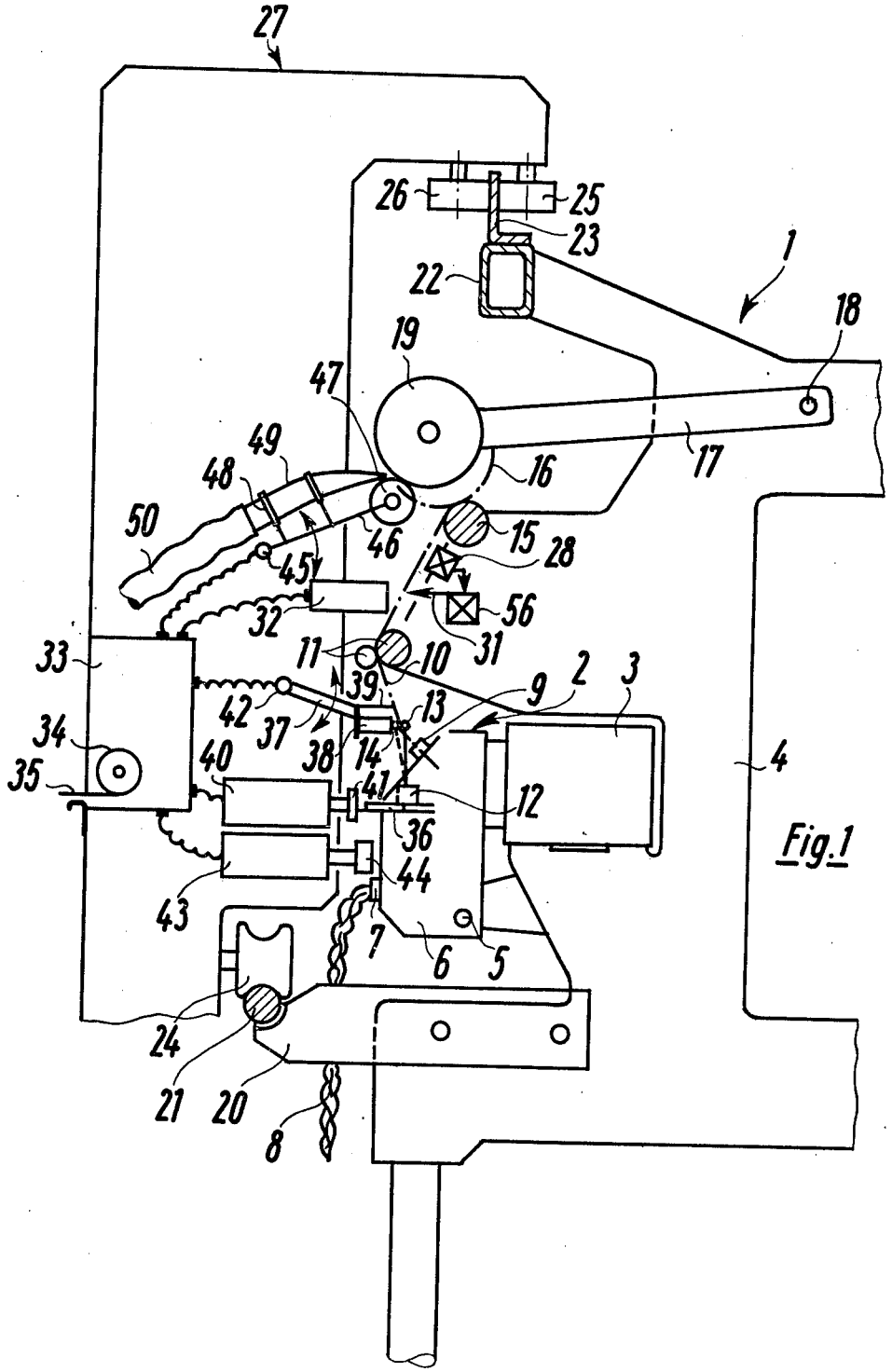
FIG. 1 is a cross sectional view through a schematically illustrated open-end spinning machine, in the region of an open-end spinning assembly, and with the servicing instrument and spinning machine including a yarn monitoring arrangement constructed in accordance with the present invention.

The illustrated embodiment according to FIG. 1 schematically shows the cross section of an open-end spinning machine 1 on a specific spinning assembly 2. Each spinning station 1 has a housing 3, in which the actual spinning elements and their bearings are disposed (not illustrated), which are fixed to a machine frame 4. There is another housing 6 which is held so that is can be swung down about a stationary shaft 5, containing — in a known way — the feed and opening elements for the silver 8 that is to be spun (likewise not illustrated). The housing 6 has an intake 7 for silver 8 that is to be delivered, as well as an outlet 9 for the spun yarn 10 which in the operational state assumes that position indicated by dot-and-dash lines, and is drawn off from spinning assembly 2 by draw off rolls 11. The drawn off yarn 10 is controlled by a yarn monitor 12 whose sensor in the operational state assumes position 13 and, when there is a yarn break is deflected in the illustrated example into the position 14 indicated by dashed lines. The function of yarn monitor 12 can be taken over also by the sensing device 28 discussed with reference to FIGS. 2 to 7. Spun yarn 10 during the spinning process is wound off on a spool 16 which is only indicated by dot-and-dash lines, which spool is applied to a friction roll 15 of the spinning machine. Spool 16 can be swung up by means of a spool arm 17, about a shaft 18, into a position 19.

On transverse supports 20 of the open-end spinning machine 1, there is disposed a rail 21 that extends below in the longitudinal direction, and also on corresponding upper transverse supports there is a shaped element 22 on which a rail 23 that also extends in the longitudinal direction bears. On these rails 21 and 23, by means of wheels 24, 25 and 26, a servicing instrument 27 can travel along spinning machine 1. Lower rail 21 here serves to accept the actual weight of mobile servicing instrument 27, via preferably two wheels 24 whereof at least one is driven. Upper wheels 25 and 26 serve primarily to accept horizontal forces.

To monitor the operational running of yarn 10, especially for periodically occurring yarn defects, there is a sensing device 28 provided at each spinning assembly 2, which senses the running yarn 10 with respect to changes in its cross section. The data obtained are transmitted after workup as explained with reference to FIGS. 2 to 5 to an intermediate storage 56 which is likewise associated with each spinning assembly. The measurements are thus stored only at the respective spinning assemblies 2, and from time to time they can be interrogated and evaluated by a non stationary process computer. In this way there need be only a relatively slight outlay for the electronic device to be installed at the respective spinning assemblies 2. The process computer 33 which is needed is disposed in the mobile servicing instrument 27, which travels past the individual spinning assemblies 2 at periodic intervals and interrogates the intermediate storage 56. For this, storage devices 56 have signal devices 31 which preferably transmit without contact the stored data to an appropriate receiver 32 of the process computer 33. In certain preferred embodiments, the process computer 33 can, if so desired, print out the transmitted evaluated values related to the respective spinning assemblies 2, on a control sheet 35 which can be looked at by the operating personnel. It is often sufficient to undertake evaluation of the control sheet 35 only once a day, whereby the operators determine which spinning assemblies 2 are malfunctioning. With an arrangement like this, other ancillary devices in the mobile servicing instrument 27 would not be needed.

It is advantageous however if—as a function of data worked up by process computer 33 — programmed actions are initiated on malfunctioning spinning assemblies 2. The function elements needed for this are only indicated schematically, and described briefly below. First there may be a lever 37 swingable about a shaft 42 of mobile servicing instrument 27 which, every time the process computer 33 determines malfunction in a spinning assembly 2, will swing up into the illustrated position and swing the yarn monitor off. Lever 37 has either a magnet 38 which deflects the sensor from its position 13 into an inoperative position 14 without contact and thus in a known way stops delivery of silver 8, or supplementarily or alternatively, lever 37 may present a cutting device 39 which will cut running yarn 10. Servicing instrument 27 can likewise present a lifting piston magnet 40, controllable by process computer 33, which can be presented via a pressure piston 41 to a sensor 36 which is present on each spinning assembly 2. This sensor 36 extends in a known way (and therefore not described in detail) out of spinning assembly 2 if a yarn break has occurred. This serves to indicate need for servicing by the spinning assembly 2 in question and to allow the halt of a servicing device that performs cleaning and/or piecing operations. By pressing in this sensor 36, process computer 33 can act via lifting piston magnet 40 so that a servicing device which may be following will not stop at this assembly 2 to remove the yarn break, and will not be operative.

Process computer 33 can also have an actuating element illustrated as a lifting piston magnet 43 which has a piston 44 that in case of yarn disturbance can press an applicator or the like against spinning assembly 2 to mark the spinning assembly.

For the situation in which on spinning assembly 2 a yarn is being produced with unacceptable defects, especially those that occur periodically, it is advantageous to pull off again and remove the length of yarn that has been wound since the previous servicing operation. For this, running yarn 10 is interrupted as described, so that a cut yarn end will be wound on spool 16 which is operational. Then spool 16 will be swung up into position 19 by a lift roll 47 on servicing instrument 27, into position 19, so that spool 16 will be lifted from friction roll 15 and the drive will be interrupted. Lift roll 47 which advantageously is drivable counter to the winding direction is disposed here on a lever 46 which can be swung about a shaft 45. A suction nozzle 49 is connected with lever 46 via retaining devices 48: suction nozzle 49 is connected via an advantageously flexible conduit 50 to a vacuum souce which is not illustrated. Suction nozzle 49 seeks the yarn end on the lifted off spool which is driven counter to the winding direction, in a known way. Then, controlled by process computer 33, the yarn length is wound off that was wound on during the period between two servicing processes of servicing instrument 27 on the spinning assembly 2 that is concerned. Data on the yarn length can be taken from the intermediate storage 56 in question. In this way it is ensured that the spool will hold only acceptable yarn. It should be understood that such a procedure always advantageously occurs before the spool exchange, in order that a full spool will not be thrown off on which defective yarn has been wound.

According to certain preferred embodiments, the servicing instrument equipped with the process computer 33 is made as an "inspection instrument" which has only one function element, e.g. function element 43, 44 which only detects malfunction and identifies the spinning assembly concerned. This identification then occurs in such a way that either the operating personnel will be summoned to do the appropriate work on the spinning assembly, or automatic servicing devices that can also travel along the spinning machine can be caused to execute the servicing operation. In most preferred embodiments however it is advantageous to equip the servicing instrument with function elements that interrupt the spinning process, which go into action if serious yarn defects are found. In this case it is then advantageous to provide also a function element that will effect the winding off of the defective yarn.

It is also contemplated to combine the servicing instrument 27 which contains the process computer 33 with servicing devices already available which execute a cleaning and/or piecing and/or exchange operation on open-end spinning assemblies 2. The process computer can then be so designed that it will transmit a starting signal to this device, to execute its programmed servicing work. It is particularly advantageous if there is a combination of the servicing instrument with a spool exchanger, because this then excludes throwing off of spools with flawed yarn.

Figure 2:
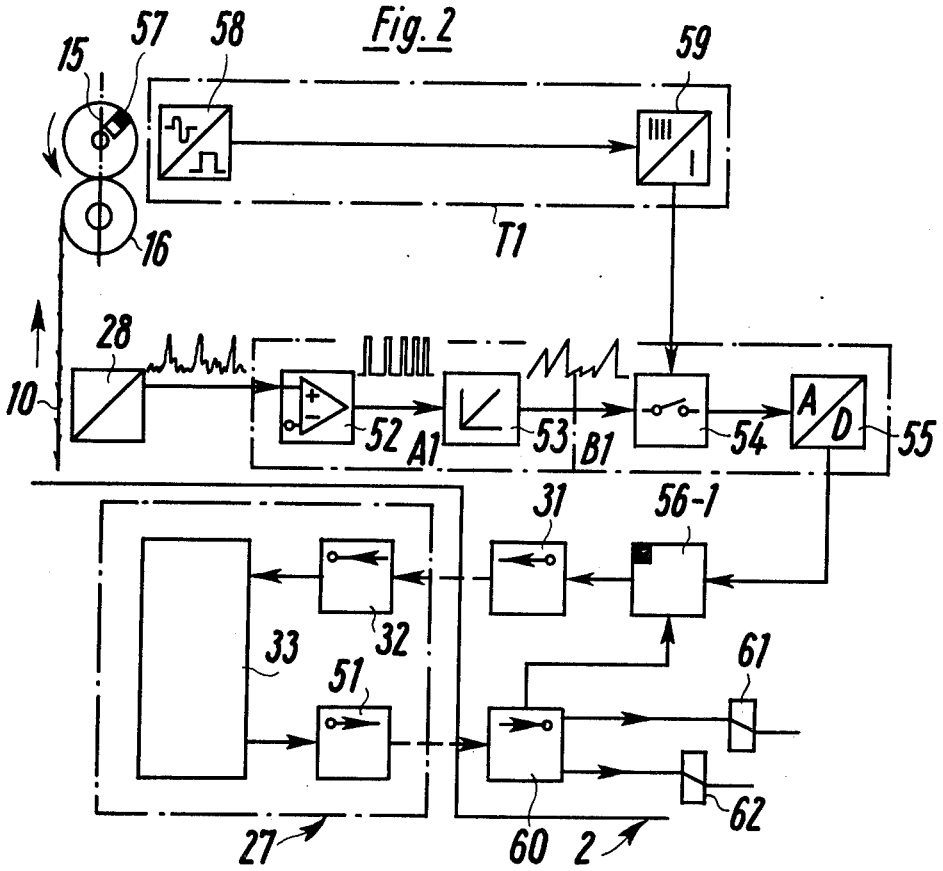
FIG. 2 is a block diagram of the electronic control and circuitry devices for detection of periodic yarn defects, according to a preferred embodiment of the invention.

The electronic switching devices schematically shown in FIG. 2 serve to determine periodically occurring yarn defects, and to store this information in an intermediate storage 56-1. These defects in the yarn may in themselves be so slight that they could be accepted, were it not that they occur periodically. This periodic occurrence in most cases is in a relationship to the geometry of the spinning assembly, particularly to the diameter of the spinning rotor and/or the opening roll that is utilized. For this reason, the distance has to be determned that the yarn irregularities in the running yarn have to each other, and to work up these values by means of values typical of the machine, in the process computer 33 which advantageously is made as a micro process computer.

In the embodiment according to FIG. 2, an evaluation stage A1 which is made as a pulse length discriminator is connected to a sensing device 28 which may function on capacitative or optoelectrical principles (e.g. see FIGS. 6 and 7 described below). This stage A1 includes a comparator 52 and an integrator 53, for example a Miller integrator. Comparator 52 responds to signals from the sensing device that exceed a predetermined threshold value. It is controlled in saturation so that it then delivers a signal pulse. With correct selection of the threshold value the pulse train thus obtained comprises preponderantly signal pulses that derive from periodic fluctuations of yarn thickness that would cause a moire effect. A sawtooth signal appears at the output of integrator 53, whose amplitudes are in proportion to the distance between the successive relative maxima in the original sensing signal, so that the data necessary for detecting yarn flaws that would lead to a moire effect can be separated from data that would be superflous for this workup.

A converter stage B1 is connected to the integrator output, which includes an electronic switch 54 and an analog-to-digital converter 55. Following this converter stage B1 there is intermediate storage 56-1, which is a solid state storage. Electronic switch 54 which is normally open will be closed periodically in a way described below, so that then the sawtooth signal formed by integrator 53 can be delivered to analog-to-digital converter 55, whose digital output signal is stored in intermediate storage 56-1. Successive maxima of the sawtooth signal and the values of the intervals in time between the relative maxima in the original sensing signal are stored in intermediate storage 56-1, so that date are available in which length distances between yarn defects appear.

The periodic closing of electronic switch 54 occurs via a trigger circuit T1. This includes a permanent magnet 57 disposed on the draw off roll 11 or on friction roll 15 (FIG. 1) of the open-end spinning assembly 2, a stationary timing pulse emitter 58 that is energized by permanent magnet 57, with an induction coil that is not illustrated, or with a proximity switch and a pulse shaper 59. Timing pulse emitter 58 and pulse shaper 59 are connected in series. The output of pulse shaper 59 is directly connected with a control input of electronic switch 54.

The operation of the form of embodiment according to FIG. 2 is discussed with reference to an example in which it is assumed that the delivery speed for yarn 10 which is wound on the winding spool is 100 m/min., and that at every 100 m yarn, a test is made for the presence of defects that would lead to moire effects. For this purpose, electonic switch 54 is closed at intervals of one minute, for one second each time. In this period about 1.5 m yarn passes sensing device 28, which yarn may have ten periodically occurring flaws that could cause a moire effect. The distance measurement of the yarn defects is done with a precision of 5%, so that for digital representation 4 bits will be required. For a two-hour period between two successive interrogations by the micro process computer disposed on the mobile servicing instrument 27 therefore, an intermediate storage 56-1 with a capacity of 10.4.120 bits is sufficient.

Each time that servicing instrument 27 stops at the open-end spinning assembly, intermediate storage 56-1 will be interrogated by the micro process computer 33. Mobile servicing instrument 27 has a control transmitter 51, controlled by micro process computer 33, with which there is associated a stationary control receiver 60 which is connected with intermediate storage 56-1. Intermediate storage 56-1 is connected with a signal transmitter 31 to which there is associated a signal receiver 32 in servicing instrument 27, said receiver being connected with micro process computer 33.

Micro process computer 33 which is also fed with information concerning the data for the spinning assembly 2 in question evaluates the digitally stored information and delivers control signals to action elements. The action can be provided at each production unit. If this involves too much outlay, it is also possible to have the action elements on the mobile servicing instrument. These action elements can actuate the function elements discussed with reference to FIG. 1 insofar as malfunction of the open-end spinning assembly 2 has been determined by micro process computer 33. Thereafter the control process is cut off so that the servicing instrument 27 can move along to the next spinning assembly 2. Advantageously, micro process computer 33 delivers a signal via its control transmitter 51 and via control receiver 60 to intermediate storage 56-1, whereby storage 56-1 will be cleared or extinguished.

Figure 3:
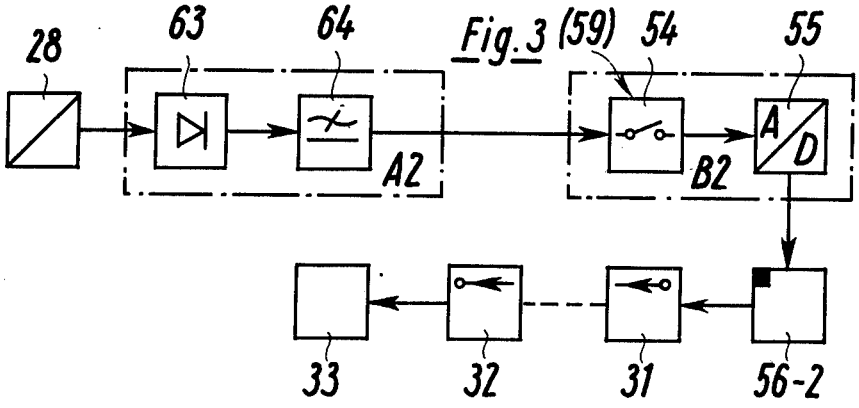
FIG. 3 is a block diagram of the electronic switching circuit for monitoring the yarn for uniformity, according to another preferred embodiment of the invention.

The electronic circuit shown in FIG. 3 will only allow monitoring of yarn 10 for its regularity, without storage and workup of the data which would be able to give an assessment of the temporal sequence of deviations and hence the danger of a moire effect. An evaluation stage A2 is connected to sensing device 28 and connected via a converter stage B2 with intermediate storage 56-2. The evaluating stage comprises a series connection of a rectifier stage 63 and an averaging or smoothing stage 64. Conversion stage B2 has an analog-to-digital converter 55 and an electronic switch 54 which is switched as in the embodiment of FIG. 2 by a trigger circuit T1 which produces a switching signal via a pulse shaper 59. As a basis for average value formation, a yarn length of 1000 m is selected. The trigger circuit is so designed that the pulse shaper emits a trigger pulse at 100 m yarn length and closes electronic switch 54. Corresponding to the slower rate of storage, it suffices here to have an intermediate storage 56-2 with a capacity of 60 bits, for example. At a yarn speed of 100 m/min. for example, it is accordingly sufficient if every ten minutes a digital signal of uniformity is supplied to intermediate storage 56-2, so that in the course of two hours there will be storage of twelve digital signals.

In intermediate storage 56-2 these twelve digital signals, for example, will be stored so that they can be addressed individually. After transmission of the stored digital values by means of a signal transmitter 31 to a signal receiver 32 of servicing instrument 27, the micro process computer 33 connected with signal receiver 32 determines the overall average and standard deviation. The micro process computer then — to the extent that there are unacceptable deviations in the yarn — acts on action elements or the like (relays) 61 and 62 (see FIG. 2 for schematic showing) which can actuate the function elements described in FIG. 1.

The embodiment of the electronic circuit device shown in FIG. 4 allows counting of the thick and thin places in running yarn 10. There are two switching circuits A3, B3 with two parallel signal channels, to which respectively intermediate storage 56-3 and 56-4 are connected. Circuits A3, B3, connected to sensing device 28, accordingly have a channel for thick places and a channel for thin places. Each of these channels has a comparator 52-1 and 52-2 as well as 8-bit counters 65 and 66 connected thereto as evaluating stages, at whose output there are connected 60-bit storages 56-3 and 56-4 respectively.

Only one pulse shaper 59 of a trigger circuit T1 which is similar to that of FIG. 2 is shown, connected with both 8-bit counters 65 and 66. The trigger circuit is so designed that it produces a trigger pulse for every 1000 m yarn length. With a trigger pulse of this kind, the digital signal indicating a flaw is stored in the 8-bit counters 65, 66 so that it can be addressed in the appurtenant intermediate storage 56-3, 56-4.

After interrogation of intermediate storage 56-3, 56-4, by the micro process computer 33 of servicing instrument 27 (not illustrated in FIG. 4) the computer determines the total number of thick places and thin places as well as the standard deviation of the digital values read out from intermediate storage 56-3, 56-4. The micro process computer 33 then ensures that if necessary the function elements mentioned in conjunction with FIG. 1 will be actuated.

In this form of embodiment as well as in all the others, it may advantageously be provided that the comparison values will not be stored from the beginning in the micro process computer 33 but that the computer will form these values itself, especially the standard deviation, from the totality of yarn quanta of all the spinning assemblies 2 that it monitors.

The embodiment of an electronic circuit shown in FIG. 5 serves to detect flaws in yarn diameter, especially thick places, that cannot be accepted, and to trigger actions e.g. by means of a relay 61. Here what are involved are rare occurrences that appear only a few times or not at all within an interrogation period of two hours. In this embodiment there is an evaluating stage A4 connected to sensing device 28 which has two parallel signal channels, namely one comprising an average stage 64 and a comparator 52-3, and a measurement channel comprising an electronic switch 54 and a holding stage 67. The sensing signal delivered by sensor 28 which represents the yarn diameter is averged in averaging stage 64. The few peaks that exceed an established relatively high threshold value of the averaged sensing signal are converted in the comparator 52-3 into square pulses with constant amplitude which briefly close electronic switch 54. During the closing of the electronic switch, a short segment of the sensing signal which represents the thick places is taken to a holding stage 67, e.g. a peak value rectifier, in which the amplitude of the sensing signal is stored for some time. The stored signal is converted in analog-to-digital converter 55 of stage B4 into a digital signal which is supplied to intermediate storage 56-5. The intermediate storage normally needs only a capacity of 15 bits. After interrogation by the micro process computer 33 of the servicing apparatus 27 (not illustrated) the number of defects and the standard deviation of flaw amplitudes is determined by the micro process computer 33, whereupon preferably action elements will be actuated that control the function element serving to wind off the yarn length which contains the unacceptable defects.

Sensing device 28 of FIGS. 6 and 7 has a square base body which presents recesses 69 and 70 at its ends, staggered with reference to each other by 90 degrees. Recess 69 is limited at the sides by two cheeks 71 in which there are long slots 72. To these cheeks 71 and in slots 72 a leaf spring 73 is adjustably fixed by means of a supporting element 74. Slots 72 are so directed that a setting crosswise to the long axis of the yarn guided through the other recess 70 is possible. A retaining bolt 75 is thrust through slots 72 and supporting element 74 which can be fixed by means of a nut 76, to cheeks 71. Before its fixation it can be turned about shaft 77 of the retaining bolt.

In the vicinity of the other recess 70 there is an inductive receiver in the form of an induction coil 78 with a ferrite core 79, which is disposed closely above the front end 80 of lead spring 73 and is fixed to a cheek of recess 70. Between the forward end 80 of lead spring 73 and ferrite core 79 there is thus produced a measuring chamber 81. Below forward end 80 of lead spring 73 there is a small plate 82 made of hard material, e.g. an oxide ceramic, fixed to the other cheek of recess 70.

Induction coil 78 can be connected in a known way to a high frequency generator. Changing of the thickness of a yarn 10 passing between the platelet and the forward end 80 of lead spring 73 will cause forward end 80 to move up and down in the direction of the axis of induction coil 78. These changes of position effect a modulation of the high frequency voltage applied to induction coil 78. By rectifying and averaging the modulated high frequency voltage, a sensing signal is obtained that represents the yarn diameter and its fluctuations.

In the embodiments of FIGS. 2 to 5, the transfer of digital information from intermediate storage 56-1 to 56-5, to the micro process computer 33 and the transfer of the control signals delivered by the computer to the organs of spinning assembly 2 are effected without contact, by means of transmitters 31, 51 and receivers 32, 60. However, non-illustrated embodiments are also contemplated wherein these transmitters and receivers are replaced by cooperating electric contacts disposed on spinning assemblies 2 and on servicing instrument 27.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Spinning machine apparatus comprising:

a plurality of spinning units, such as open-end spinning units, which each produce a running yarn, yarn measuring means at each of said spinning units for determining the transverse dimension of the running yarn at the respective spinning units, intermediate storage means at each of said spinning units for storing yarn measurement data obtained by said yarn measuring means, electronic switching circuit means interconnecting said yarn measuring means and said intermediate storage means, a mobile servicing instrument which is selectively movable to respective servicing positions adjacent the respective spinning units, a process computer carried by said mobile servicing instrument, connecting means for selectively connecting said process computer with respective ones of said intermediate storage means so that said process computer can process the yarn measurement data stored in said intermediate storage means, and at least one function element including means for executing a servicing operation at respective ones of said spinning units, said at least one function element being controlled by the process computer as a function of the yarn measurement data supplied thereto by said connecting means.

2. Apparatus according to claim 1, wherein the mobile servicing instrument has a function element to identify a malfunctioning spinning unit.

3. Apparatus according to claim 2, wherein the mobile servicing instrument has a function element for interruption of the work process of a malfunctioning spinning unit.

4. Apparatus according to claim 2, wherein the mobile servicing instrument has a function element which is selectively presentable to a switch that will prevent automatic switching on again of a malfunctioning spinning unit.

5. Apparatus according to claim 1, wherein the mobile servicing instrument has a function element for interruption of the work process of a malfuncting spinning unit.

6. Apparatus according to claim 5, wherein the mobile servicing instrument has a function element which is selectively presentable to a switch that will prevent automatic switching on again of a malfunctioning spinning unit.

7. Apparatus according to claim 1, wherein the mobile servicing instrument has a device controlled by the process computer for delivering a control sheet containing the yarn measurement data of the respective spinning units.

8. Apparatus according to claim 1, wherein the mobile servicing instrument includes as a function element, a device controlled by the process computer that can be presented to a winding spool of the spinning unit being monitored, to wind off and separate a specific length of yarn as determined by the process computer.

9. Apparatus according to claim 1, wherein the process computer with its interrogating and control devices and the function elements that it controls is combined with a servicing device which executes a cleaning and/or a yarn piecing and/or a spool exchange.

10. Apparatus according to claim 1, wherein said electronic switching circuit means includes a trigger circuit (T1) at each spinning unit which is synchronized by the drive of a yarn draw off device or a winding spool of the respective spinning unit, said trigger circuit including means for controlling a periodic storing of measured yarn dimension values in the intermediate storage means of said spinning unit.

11. Apparatus according to claim 10, wherein the electronic switching circuit means includes at least two switching circuit stages with the appurtenant intermediate storage means, whereof one of said stages is an evaluation stage and the other is a converter stage.

12. Apparatus according to claim 11, wherein the evaluation stage is provided so as to produce signals that correspond to the temporal sequence of variations in cross section of the running yarn.

13. Apparatus according to claim 12, wherein a pulse length discriminator is used as the evaluation stage.

14. Apparatus according to claim 11, wherein a rectifier stage and an averaging stage/connected therewith in series serve as the evaluation stage.

15. Apparatus according to claim 11, wherein a series connection of a comparator and a pulse counter is provided as the evaluation stage.

16. Apparatus according to claim 15, wherein the evaluation stage and the connector stage present two signal channels which lead to their own intermediate storage means.

17. Apparatus according to claim 1, wherein the electronic switching circuit means includes at least two switching circuit stages with the appurtenant intermediate storage means, whereof one of said stages is an evaluation stage and the other is a converter stage, wherein the evaluation stage includes a comparator and a hold stage which is connected via a switch controlled by the comparator with the yarn measuring means and is connected to the conversion stage.

18. Apparatus according to claim 1, wherein said connecting means includes circuit members for contactless transmission of the stored values to the process computer and of the control signals from the process computer to the function elements, said circuit members including associated transmitters and receivers.

19. Apparatus according to claim 1, wherein said connecting means includes circuit members with associated electric contacts for transmission of the stored values to the process computer and the control signals of the process computer to the function elements.

20. Apparatus according to claim 1, wherein said process computer includes means for clearing said intermediate storage means.

* * * * *